US009950530B2

(12) United States Patent
Imamura

(10) Patent No.: US 9,950,530 B2
(45) Date of Patent: Apr. 24, 2018

(54) LIQUID EJECTION HEAD AND METHOD FOR MANUFACTURING THE SAME

(71) Applicant: CANON KABUSHIKI KAISHA, Tokyo (JP)

(72) Inventor: Isao Imamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/209,076

(22) Filed: Jul. 13, 2016

(65) Prior Publication Data

US 2017/0015100 A1 Jan. 19, 2017

(30) Foreign Application Priority Data

Jul. 15, 2015 (JP) ..... 2015-141493

(51) Int. Cl.
*B41J 2/14* (2006.01)
*B41J 2/16* (2006.01)

(52) U.S. Cl.
CPC ..... *B41J 2/1623* (2013.01); *B41J 2/1433* (2013.01); *B41J 2/14072* (2013.01); *B41J 2/1603* (2013.01); *B41J 2002/14362* (2013.01); *B41J 2202/03* (2013.01)

(58) Field of Classification Search
CPC ..... B41J 2/1623; B41J 2/1433; B41J 2/162; B41J 2002/14491; B41J 2202/22; B41J 2202/03
See application file for complete search history.

(56) References Cited

U.S. PATENT DOCUMENTS

2004/0183193 A1* 9/2004 Koide ..... H01L 23/49833 257/734
2006/0228561 A1* 10/2006 Nakamura ..... C08G 59/621 428/413
2008/0031009 A1* 2/2008 Kodaira ..... H01L 33/58 362/612
2012/0308747 A1* 12/2012 Dennis ..... C03C 8/04 428/34

FOREIGN PATENT DOCUMENTS

JP 2002-019120 A 1/2002
JP 2005-132102 A * 5/2005 ..... B41J 2/16

* cited by examiner

*Primary Examiner* — Yaovi M Ameh
(74) *Attorney, Agent, or Firm* — Canon U.S.A., Inc. IP Division

(57) ABSTRACT

A first sealant for sealing a region under an electrical connection portion and a second sealant for sealing a region on the electrical connection portion are used as sealants for the electrical connection portion for connecting an electric wiring member to an ejection energy generation element of a liquid ejection head, these sealants contain the same base agent and curing agent, and the linear expansion coefficients of the first sealant and the second sealant after curing are adjusted so as to become in a predetermined range.

14 Claims, 2 Drawing Sheets

LIQUID EJECTION HEAD AND METHOD FOR MANUFACTURING THE SAME

BACKGROUND OF THE INVENTION

Field of the Invention

The present invention relates to a liquid ejection head for ejecting a liquid, e.g., ink, and a method for manufacturing the same.

Description of the Related Art

Recording of characters, images, and the like and a surface treatment by a liquid ejection head typified by an inkjet recording head are performed by imparting thermal energy or vibration energy to a liquid, e.g., ink, and ejecting the liquid as very small droplets from an ejection port so as to apply the liquid to a predetermined position on a recording medium. Japanese Patent Laid-Open No. 2002-019120 describes a method for manufacturing a liquid jet recording head which is one form of the liquid ejection head.

In the manufacturing method disclosed in Japanese Patent Laid-Open No. 2002-019120, a recording element substrate having an ejection port, a flow passage, an ejection energy generation element, and the like is attached to a supporting plate composed of alumina or the like, and the recording element substrate is electrically bonded to a flexible printed circuit board serving as an electric wiring member.

Subsequently, a peripheral sealant for protecting the side surface of the recording element substrate from ink, dust, and the like is applied. After the peripheral sealant is cured, an inner lead bonding (ILB) sealant (electrical connection portion sealant) for sealing an electrical connection portion is applied thereto.

The functions required of the peripheral sealant used for sealing the peripheral portion of the recording element substrate and the electrical connection portion sealant are as described below.

The peripheral sealant is required to flow into a gap with a width of less than 1 mm, which is formed between a part on the supporting plate and the recording element substrate, in a short time so as to fill the gap promptly. In addition, it is necessary to protect the recording element substrate from ink and other factors.

The electrical connection portion sealant is required to seal the electrical connection portion, as a matter of course. In addition, it is required that the sealant does not peel when rubbed with a blade, a wiper, or the like for cleaning a surface provided with an ink ejection port or when coming into contact with paper and the like because of paper-jamming.

Japanese Patent Laid-Open No. 2005-132102 describes a method in which a peripheral sealant and an electrical connection portion sealant are cured at the same time so as to improve the production efficiency. Japanese Patent Laid-Open No. 2005-132102 describes a method in which the hardness of the electrical connection portion sealant after curing is made higher than the hardness of the peripheral sealant after curing, the electrical connection portion sealant and the peripheral sealant are made to contain the same material as the base agent and the curing agent, and these sealants are stacked by coating.

According to this method, even when the peripheral sealant and the electrical connection portion sealant are cured at the same time, a difference in reactivity with a curing agent between the two sealants due to a difference in the curing rate between the two sealants (hindrance to curing) does not occur.

SUMMARY OF THE INVENTION

A liquid ejection head according to the present invention includes a recording element substrate, which has a flow passage member including an ejection port for ejecting a liquid and a flow passage for supplying the liquid to the ejection port and a substrate having an ejection energy generation element for generating energy so as to eject the liquid from the ejection port, an electric wiring member for transmitting a signal so as to drive the ejection energy generation element, an electrical connection portion for electrically connecting the recording element substrate to the electric wiring member, a first sealant for sealing a region under the electrical connection portion, and a second sealant for sealing a region on the electrical connection portion, wherein the first sealant and the second sealant contain the same base agent and curing agent, and the ratio ($\alpha 1/\alpha 2$) of the linear expansion coefficient ($\alpha 1$) of the first sealant to the linear expansion coefficient ($\alpha 2$) of the second sealant is 1.2 to 1.0.

A method for manufacturing a liquid ejection head including a recording element substrate, which has a flow passage member including an ejection port for ejecting a liquid and a flow passage for supplying the liquid to the ejection port and a substrate having an ejection energy generation element for generating energy so as to eject the liquid from the ejection port, an electric wiring member for transmitting a signal so as to drive the ejection energy generation element, and an electrical connection portion for electrically connecting the recording element substrate to the electric wiring member, according to the present invention, the method comprising the steps of filling a region under the electrical connection portion with a first sealant, stacking a second sealant for sealing a region on the electrical connection portion on the first sealant in the region under the electrical connection portion, so as to cover the electrical connection portion, and curing the first sealant and the second sealant at the same time, wherein the first sealant and the second sealant contain the same base agent and curing agent, and the ratio ($\alpha 1/\alpha 2$) of the linear expansion coefficient ($\alpha 1$) of the first sealant to the linear expansion coefficient ($\alpha 2$) of the second sealant is 1.2 to 1.0.

Further features of the present invention will become apparent from the following description of exemplary embodiments with reference to the attached drawings.

DESCRIPTION OF THE EMBODIMENTS

Figure 1A:
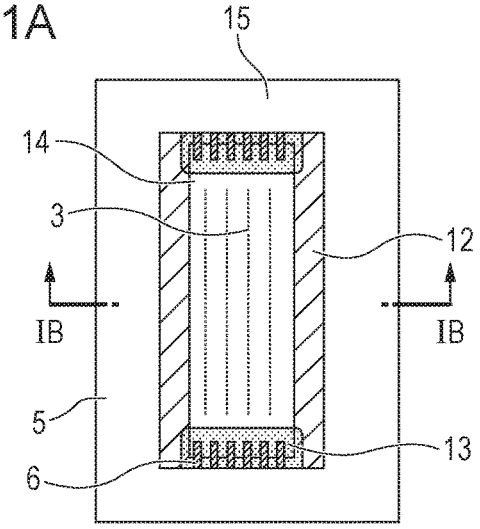
FIGS. 1A to 1C are schematic diagrams showing the configuration of a liquid ejection head.

The viscosity of a peripheral sealant, part of which serves as a sealant for a region under leads, is set at a low level because the sealant has to flow under the leads. On the other hand, the viscosity of an electrical connection portion sealant serving as a sealant for a region on leads is required to be high in consideration of coatability on the electrical connection portion. In the case where the viscosity of the sealant is adjusted by changing the amount of the filler introduced, the amount of the filler introduced to the peripheral sealant is smaller than the amount of the filler introduced to the electrical connection portion sealant. Consequently, the sealant for the region under leads is different from the sealant for the region on leads in terms of linear expansion coefficient. Even when the base agent and the curing agent are common to these sealants, the linear expansion coefficients of the sealants present in the regions on and under the leads are different from each other and, thereby, an interface is generated. As a result, long-term durability of the electrical connection portion is not obtained in some cases.

The present invention solves the above-described issues. That is, the present invention enhances the durability of the sealants of an electrical connection portion by adjusting the linear expansion coefficients of the sealant for a region under leads and the sealant for a region on leads so as to further enhance the reliability of a liquid ejection head.

A liquid ejection head according to the present invention includes a recording element substrate and an electric wiring member for transmitting a signal so as to drive an ejection energy generation element, and the recording element substrate is electrically connected to the electric wiring member through an electrical connection portion.

The recording element substrate has a flow passage member including an ejection port for ejecting a liquid and a flow passage for supplying the liquid to the ejection port and an ejection energy generation element for generating energy so as to eject the liquid from the ejection port.

The ejection energy generation element is driven by inputting an electric signal from the electric wiring member. Various connection methods are used for forming the electrical connection portion between the ejection energy generation element disposed in the recording element substrate and the electric wiring member outside the recording element substrate. For example, the electrical connection portion is formed by electrically bonding a lead included in the electric wiring member to a terminal, e.g., an electrode pad or a bump, of a wire connected to the ejection energy generation element in the recording element substrate.

A sealant for sealing the electrical connection portion is composed of a first sealant for sealing a region under the electrical connection portion and a second sealant for sealing a region on the electrical connection portion. In the case where the electric wiring member is bonded to the wiring terminal of the ejection energy generation element in the recording element substrate by utilizing the lead, a region under the lead is the region under the electrical connection portion and a region covering the lead is the region on the electrical connection portion. A peripheral sealant for sealing the side surface surrounding the recording element substrate can be utilized as the first sealant.

In the present invention, the first sealant and the second sealant contain the same base agent and curing agent and the ratio ($\alpha 1/\alpha 2$) of the linear expansion coefficient ($\alpha 1$) of the first sealant to the linear expansion coefficient ($\alpha 2$) of the second sealant is adjusted so as to become in the range of approximately 1.2 to 1.0.

The embodiments according to the present invention will be described below with reference to the drawings.

EMBODIMENTS

Figure 1B:
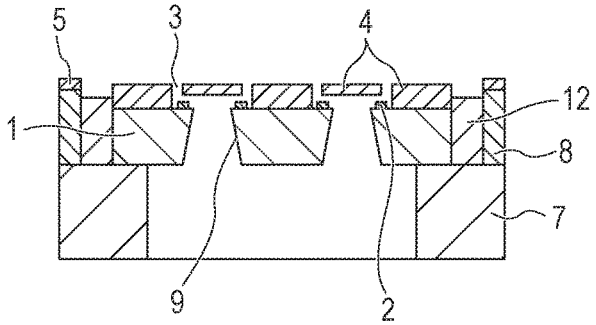
Figure 1C:
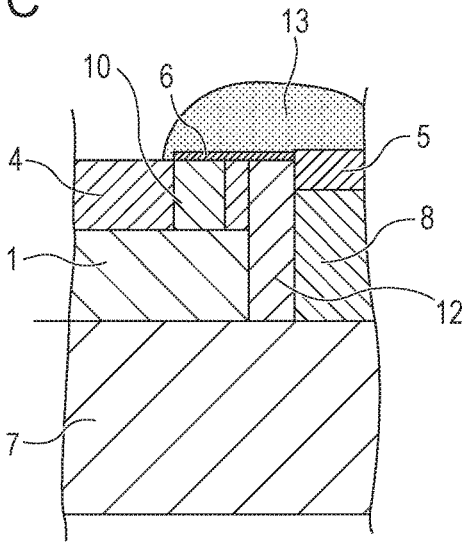

FIG. 1A is a schematic plan view of an inkjet recording head (hereafter referred to as "recording head"), which is one form of the liquid ejection head, viewed from the ink ejection direction. FIG. 1B is a partial sectional view of a cross-section along a line IB-IB shown in FIG. 1A. FIG. 1C is a partial sectional view schematically showing the structure of a sealed electrical connection portion along the arrangement direction of a lead.

The recording head shown in the drawings has a configuration in which two ink supply ports 9 are disposed in one substrate 1, and an ejection port array composed of four lines of ejection ports 3 is disposed by a flow passage member 4. The same ink supplied through the two ink supply holes 9 is ejected from the ejection ports 3 by the energy imparted from ejection energy generation elements 2.

An electrical connection portion sealant (sealant for a region on leads) 13 serving as a second sealant requires high elastic modulus (high hardness) after curing so as to have a function of protecting the leads 6. Consequently, the sealant is filled with a filler, e.g., silica, to a high extent. The thixotropic property has to be imparted in order to leave the sealant in the region on the leads 6. In addition, the thixotropic property has to be imparted while the fluidity is secured to some extent. Therefore, the viscosity and the thixotropic property of the electrical connection portion sealant serving as the second sealant are selected from the ranges of high viscosity and high thixotropic property employed for the electrical connection portion sealant.

A peripheral sealant (sealant for a region under leads) 12 serving as a first sealant has to flow into the region under the leads and around a recording element substrate 14 and low viscosity and a low thixotropic property are required. Therefore, the viscosity and the thixotropic property of the first sealant are selected from the ranges of low viscosity and low thixotropic property employed for the peripheral sealant.

Regarding the first sealant and the second sealant containing common base agent and curing agent, the following methods may be used as for satisfying the above-described requirements respectively.

(A) The first sealant having a reduced viscosity and a reduced thixotropic property is obtained by removing the thixotropic agent from the second sealant (electrical connection portion sealant).

(B) The amounts of the fillers in the first sealant and the second sealant are adjusted such that the difference in linear expansion coefficient becomes within the range specified above and, in addition, the viscosity of the first sealant is reduced by increasing the average particle diameter of the filler so as to decrease the specific surface area of the filler.

(C) The amounts of the fillers in the first sealant and the second sealant are adjusted such that the difference in linear expansion coefficient becomes within the range specified above and the viscosity of the first sealant is reduced by removing a portion having small particle diameters from the filler so as to decrease the specific surface area of the filler.

(D) The first sealant and the second sealant including the same amount of the same type of filler are prepared. At that time, the average particle diameters of the fillers contained in the two sealants are made equal or the average particle diameter of the filler contained in the first sealant is made larger than the average particle diameter of the filler contained in the second sealant such that the difference in linear expansion coefficient becomes in the range specified above.

(E) The first sealant and the second sealant are filled with the same type of filler. At that time, the amount of the filler in the first sealant is made larger than the amount of the filler in the second sealant and the average particle diameter of the filler contained in the first sealant is made larger than the average particle diameters of the filler contained in the second sealant.

At least two of these methods may be combined.

For example, two types of sealants, that is, the first sealant and the second sealant, may be obtained from one type of sealant by applying at least one of the methods described in the items (A) to (E) to a known or commercially available sealant or a combination of known or commercially available base agent and curing agent for a sealant.

Examples of a method for specifying the ratio ($\alpha1/\alpha2$) of the linear expansion coefficient of the first sealant to the linear expansion coefficient of the second sealant as 1.2 to 1.0 include a method in which each of the amounts of the fillers in these sealants (parts by mass of the filler relative to the entire sealant) is adjusted. The linear expansion coefficient of the sealant is determined mainly on the basis of the amount of the filler. Therefore, the ratio ($\alpha1/\alpha2$) of the linear expansion coefficients of two sealants filled with the same amount of the filler does not become less than 1. In the case where the amount of the filler in the second sealant is made larger than the amount of the filler in the first sealant, the ratio ($\alpha1/\alpha2$) of the linear expansion coefficients becomes 1 or more. In the present invention, the amounts of the fillers in the first sealant and the second sealant can be adjusted such that the ratio ($\alpha1/\alpha2$) of the linear expansion coefficients becomes in the range of approximately 1.2 or less.

In the present invention, the long-term reliability of the inkjet recording head is enhanced by specifying the ratio ($\alpha1/\alpha2$) of the linear expansion coefficient of the first sealant to the linear expansion coefficient of the second sealant as 1.2 to 1.0.

Large amounts of the filler can be added to both the first sealant and the second sealant because, as a result, the amount of the filler in the first sealant serving as the peripheral sealant increases and the ink resistance and the electrical characteristics are enhanced. Even when the amount of the filler is not changed, an increase in linear expansion coefficient can be suppressed by decreasing the specific surface area of the filler.

In the present invention, the ratio ($\alpha1/\alpha2$) of the linear expansion coefficient of the first sealant to the linear expansion coefficient of the second sealant is specified as 1.2 to 1.0. Consequently, long-term durability is obtained because generation of an interface between the first sealant and the second sealant due to generation of stress based on heat expansion does not occur and peeling between these sealants and the like do not occur. Therefore, regarding even long lengths of recording element substrate with ejection ports arranged in a high density, high-definition, good liquid ejection performance is obtained in the long term because stress is not applied, the durability of the electrical connection portion is enhanced, and the reliability is high.

The inkjet recording head shown in FIGS. 1A to 1C may be produced by the following method.

The recording element substrate 14 is placed and fixed at a predetermined position in an opening portion formed by a horizontal periphery sealing portion 8 fixed on the support member 7. Subsequently, the electrical connection portion is formed by bonding terminals 10 of the wires for transmitting signals to an ejection energy generation element 2 of the recording element substrate 14 to leads 6 of an electric wiring member 5. A known method may be used for bonding them to each other.

Figure 2A:
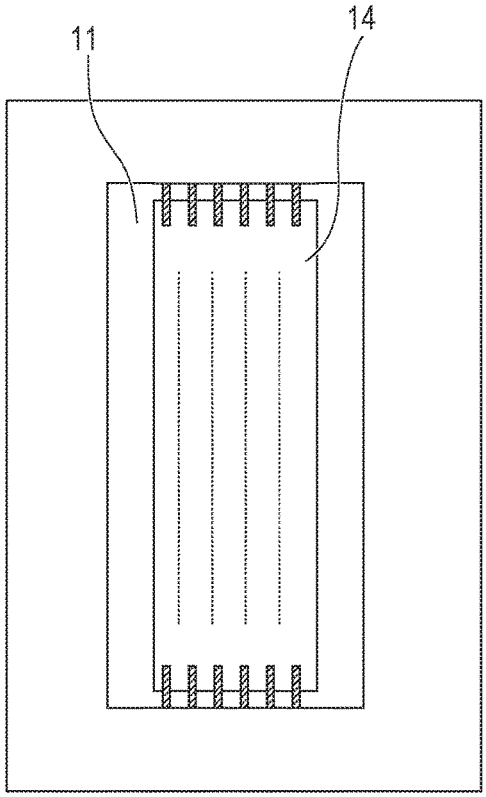
FIGS. 2A and 2B are plan views of a liquid ejection head, schematically showing sealing steps according to the present invention.

FIG. 2A is a schematic plan view showing the state of this stage. A recess portion 11 is formed between the side surface of the recording element substrate 14 and the inner side surface of the horizontal periphery sealing portion 8 located under the electric wiring member 5 by these side surfaces and the surface of the support member 7.

Figure 2B:
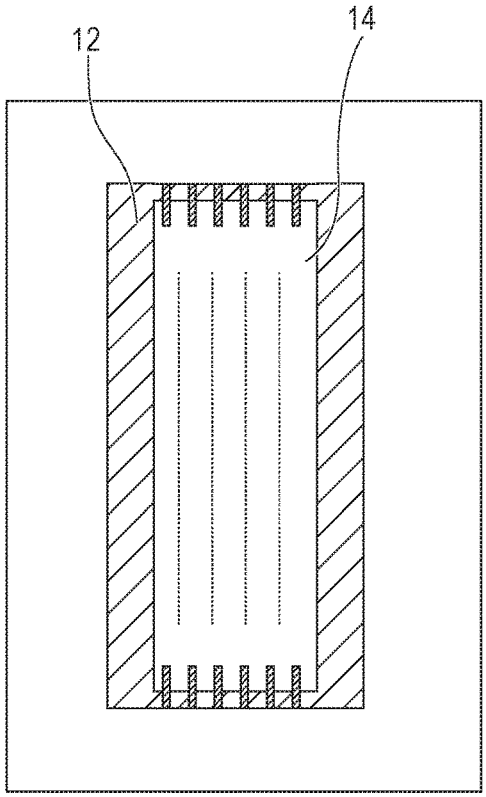

The recess portion 11 is filled with a first sealant 12. It is not possible to directly fill the region under the leads 6 with the first sealant by a dispenser or the like. Therefore, the first sealant is made to go around and is introduced to the region under the leads 6 from the side of the leads 6. FIG. 2B is a schematic plan view of the state in which the first sealant 12 has been introduced.

Then, a portion on the connection portions of the terminals 10 and the leads 6, that is, a region on the electrical connection portion, is covered with a second sealant 13, as shown in FIG. 1C. At this stage, the first sealant is covered with the second sealant, and a portion in which a layer of the first sealant and a layer of the second sealant are stacked is generated.

The first sealant 12 and the second sealant 13 are cured at the same time so as to form a sealing portion composed of a cured material of these sealants, and the sealing operation is finished.

The first sealant 12 and the second sealant 13 contain the same base agent and curing agent. Therefore, it is possible to perform curing at the same time under the same condition, an interface is not generated between these sealant layers after the curing, and a structure in which the sealing portion produced by integration of the sealants envelopes the electrical connection portion is obtained. The resulting sealing portion is strong and has excellent long-term durability, and the reliability of the liquid ejection head is improved.

The base agent and the curing agent used for the first sealant and the second sealant commonly are not specifically limited as long as the target sealing function is exhibited and may be selected from the materials used for assembling the liquid ejection head.

The base agent used for the first sealant and the second sealant commonly may be selected from liquid materials usable as the base agent of a sealant. Specific examples of the base agent include bisphenol epoxy resins, bromine-containing epoxy resins, phenol or cresol type epoxy resins, cycloaliphatic epoxy resins, glycidyl ester resins, glycidyl amine resins, heterocyclic epoxy resins, silicone-modified products thereof, polybutadiene-modified products thereof, urethane-modified products thereof, and polyfunctional materials derived therefrom by using pentaerythritol, trimethylol propane, glycerin, or the like.

Base agents having at least an epoxy group as a polymerizable group can be particularly employed because excellent chemical resistance is exhibited.

The curing agent only needs to be able to cure the base agent in order that a target hardness is ensured. The curing agent is selected in accordance with the type of the base agent in consideration of the compatibility with the base agent. Examples thereof include amine curing agents, acid and acid anhydride curing agents, resol type phenol resins in which hydroxyl groups in an epoxy resin serve as cross-linking points, urea resins, melamine resins, isocyanates, and block isocyanates.

Acid anhydride curing agents can be used. Examples of acid anhydride curing agents include aliphatic acid anhydrides, e.g., dodecenyl succinic anhydride (DDSA), alicyclic acid anhydrides, e.g., methyltetrahydrophthalic anhydride (Me-THPA), aromatic acid anhydrides, e.g., phthalic anhydride (PA), and halogen based acid anhydrides, e.g., HET anhydride.

The amount of mixing of the acid anhydride curing agent is selected preferably within the range of 90 to 99 percent by mass relative to a base agent epoxy equivalent.

A filler may be added to the sealant for the purpose of adjusting the hardness, the thixotropic property, the shape keeping property, the viscosity, and the like. Examples of fillers include silica, carbon black, titanium oxide, kaoline, clay, and calcium carbonate.

The amount of the filler introduced to the sealant, that is, the content of the filler relative to the entire sealant, may be selected in accordance with the properties of a target sealant. The content may be selected within the range of 50 to 80 percent by mass relative to the entire sealant in accordance with the characteristics of a target sealant, although the content changes depending on the type, particle shape, particle diameter, and the like of the filler.

Additives and the like may be added to the sealant in order to improve various types of performance. Examples of additives include silane coupling materials for enhancing the adherence of silicon wafers and the like to inorganic materials, debubbling materials for improving debubbling efficiency, and amines, reactive monomers, catalysts, and the like for performing adjustment, e.g., facilitation or control of viscosity and reactivity.

EXAMPLES

Examples 1 to 3 and Comparative Example 1

Each sealant shown in Table 1 was prepared by using a sealant curable by an epoxy resin acid anhydride.

Next, sealants used in each of the examples will be described.

Regarding Sealant 1, the thixotropic agent is removed from Sealant 5 used as an electrical connection portion sealant and the viscosity and the thixotropic property are reduced. Sealant 1 has somewhat high viscosity. Therefore, regarding Sealant 2, the viscosity is reduced by increasing the average particle diameter of silica serving as the filler so as to decrease the specific surface area of the filler.

The amounts of the filler in Sealants 1, 2, and 5 are the same and, therefore, the linear expansion coefficients become equal. Regarding Sealant 3, reduction in viscosity is intended by decreasing the amount of the filler to a great extent in consideration of linear expansion variation between materials.

As described above, the amount of the filler in the sealant for peripheral sealing (sealant for a region under leads), serving as the first sealant, does not exceed the amount of the filler in the electrical connection portion sealant (sealant for a region on leads), serving as the second sealant. Consequently, the ratio ($\alpha 1/\alpha 2$) of the linear expansion coefficient of the peripheral sealant (sealant for a region under leads) to the linear expansion coefficient of the electrical connection portion sealant (sealant for a region on leads) does not become lower than 1.

As shown in FIG. 1C and FIG. 2B, the electrical connection portion connected to the leads was subjected to a sealing treatment by using the sealants shown in Table 1 in combination shown in Table 2. Initially, each of the peripheral sealants of Examples 1 to 3 and Comparative example shown in Table 2 was used so as to perform coating, as

TABLE 1

| | | | Filler (fused silica) | | | Properties | | | |
|---|---|---|---|---|---|---|---|---|---|
| Sealant | Coating area | Resin component | Amount of filling (percent by mass) | Average particle diameter (μm) | Thixotropic agent | Viscosity (Pa · s) | Thixotropic ratio | Elastic modulus (GPa) | Linear expansion coefficient (ppm) |
| Sealant 1 | peripheral portion of recording element substrate including region under leads | curable by epoxy resin acid anhydride | 70 | 10 | none | 41 | 2 | 15 | 16 |
| Sealant 2 | | | 70 | 20 | none | 26 | 1.3 | 15 | 16 |
| Sealant 3 | | | 67 | 20 | none | 22 | 1.2 | 13 | 19 |
| Sealant 4 | | | 60 | 10 | none | 12 | 1.4 | 10 | 28 |
| Sealant 5 | region on leads | | 70 | 10 | yes | 300 | 3 | 15 | 16 |

Measurement conditions:
Viscosity: Brookfield type viscometer, 10 rpm
Thixotropic ratio: Brookfield type viscometer, 1 rpm/10 rpm
Elastic modulus: DMA method, curing condition 100° C. 3 hr
Linear expansion coefficient: TMA method, curing condition 100° C. 3 hr Each sealant composition shown in Table 1 will be described below.

Regarding Sealant 4 used as a comparative sealant (peripheral sealant), the thixotropic agent is removed from Sealant 5 used as an electrical connection portion sealant and the amount of the filler added is decreased.

shown in FIG. 2B. At this time, it was not possible to directly coat the region under the leads 6 by a dispenser or the like because of space. Therefore, the region beside the lead portion was coated with the sealant, and the sealant was made to flow into the region under the leads. The peripheral sealant of Example 1 had viscosity somewhat higher than those of the Examples 2 and 3 and Comparative example and took somewhat much time to detour under the leads.

Subsequently, coating with the electrical connection portion sealant (region on leads) was performed, as shown in FIGS. 1A and 1C, and the entire sealant was heat-cured.

The thus produced recording head 15 was subjected to a heat shock (H/S) test, where heat treatments at 0° C. for 1 hour and at 80° C. for 1 hour were performed repeatedly while the sealant portion was dipped in ink. The obtained results are shown in Table 2.

TABLE 2

| | Coating area | | | Evaluation result | |
|---|---|---|---|---|---|
| | peripheral sealing (sealant for region under leads) | Electrical connection portion sealing (Sealant for region on leads) | Ratio of linear expansion coefficient | H/S 100 cycles | H/S 200 cycles |
| Example 1 | Sealant 1 | Sealant 5 | 1.0 (16:16) | ○ | ○ |
| Example 2 | Sealant 2 | Sealant 5 | 1.0 (16:16) | ○ | ○ |
| Example 3 | Sealant 3 | Sealant 5 | 1.2 (19:16) | ○ | ○ |
| Comparative example 1 | Sealant 4 | Sealant 5 | 1.8 (28:16) | ○ | X |

Evaluation
○: no change
X: crack

As shown in Table 2, regarding Examples 1 to 3 and Comparative example 1, no change was observed up to 100 cycles. When 100 cycles were further performed so as to reach 200 cycles, regarding Comparative example 1, fine cracks were observed at the borders between the peripheral sealant, the electrical connection portion sealant, and the recording element substrate.

The reason for this is considered to be that the proportion of the resin, which swells with ink, in the peripheral sealant of Comparative example 1 is higher than the proportions in the peripheral sealants of Examples 1 to 3, a difference in linear expansion coefficient from the electrical connection portion sealant is also large and, thereby, the stress applied during heating is large.

On the other hand, regarding Examples 1 to 3, the ratio ($\alpha 1/\alpha 2$) of the linear expansion coefficient of the first sealant serving as the peripheral sealant (sealant for a region under leads) to the linear expansion coefficient of the second sealant serving as the electrical connection portion sealant (sealant for a region on leads) is 1.2 to 1.0. As a result, it is considered that regarding Examples 1 to 3, the stress did not generated in contrast to Comparative example 1 and the durability was improved. That is, according to the present invention, the long-term reliability of the head is enhanced by specifying the ratio ($\alpha 1/\alpha 2$) of the linear expansion coefficient of the peripheral sealant to the linear expansion coefficient of the electrical connection portion sealant as 1.2 to 1.0. As a result, the ink resistance and the electrical characteristics of the peripheral sealant are enhanced because the filler content increases. Also, as shown in Example 2, even in the case where the amount of the filler introduced does not change, it is effective to suppress an increase in linear expansion coefficient by decreasing the specific surface area of the filler.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-141493, filed Jul. 15, 2015, which is hereby incorporated by reference herein in its entirety.

What is claimed is:

1. A liquid ejection head comprising:

a recording element substrate, which has a flow passage member including an ejection port for ejecting a liquid and a flow passage for supplying the liquid to the ejection port and a substrate having an ejection energy generation element for generating energy so as to eject the liquid from the ejection port;

an electric wiring member for transmitting a signal so as to drive the ejection energy generation element;

an electrical connection portion for electrically connecting the recording element substrate to the electric wiring member;

a first sealant for sealing a region under the electrical connection portion; and a second sealant for sealing a region on the electrical connection portion, wherein the first sealant and the second sealant contain the same base agent, curing agent and filler, wherein the ratio ($\alpha 1/\alpha 2$) of the linear expansion coefficient ($\alpha 1$) of the first sealant to the linear expansion coefficient ($\alpha 2$) of the second sealant is 1.2 to 1.0, and wherein the base agent has an epoxy group and the curing agent is an acid anhydride curing agent, and wherein the content of the acid anhydride curing agent included in the first sealant and the content of the acid anhydride curing agent included in the second sealant are within the range of 90 to 99 percent by mass relative to an epoxy equivalent of the base agent.

2. The liquid ejection head according to claim 1, wherein the first sealant and the second sealant have the same type of filler.

3. The liquid ejection head according to claim 1, wherein the average particle diameter of the filler included in the first sealant is larger than the average particle diameter of the filler included in the second sealant.

4. The liquid ejection head according to claim 1, wherein the filler is silica.

5. The liquid ejection head according to claim 1, wherein the first sealant does not contain a thixotropic agent and the second sealant contains a thixotropic agent.

6. The liquid ejection head, according to claim 1, wherein the difference between the content of the filler included in the first sealant relative to the first sealant and the content of the filler included in the second sealant relative to the second sealant is within 3 percent by mass.

7. The liquid ejection head, according to claim 1, wherein the content of the filler included in the first sealant relative to the first sealant and the content of the filler included in the second sealant relative to the second sealant are within the range of 50 to 80 percent by mass.

8. A method for manufacturing a liquid ejection head including a recording element substrate, which has a flow passage member including an ejection port for ejecting a liquid and a flow passage for supplying the liquid to the ejection port and a substrate having an ejection energy generation element for generating energy so as to eject the liquid from the ejection port, an electric wiring member for transmitting a signal so as to drive the ejection energy generation element, and an electrical connection portion for electrically connecting the recording element substrate to the electric wiring member, the method comprising the steps of:

filling a region under the electrical connection portion with a first sealant;

stacking a second sealant for sealing a region on the electrical connection portion on the first sealant in the region under the electrical connection portion, so as to cover the electrical connection portion; and curing the first sealant and the second sealant at the same time, wherein the first sealant and the second sealant contain the same base agent and curing agent, and filler, wherein the ratio ($\alpha 1/\alpha 2$) of the linear expansion coefficient ($\alpha 1$) of the first sealant to the linear expansion coefficient ($\alpha 2$) of the second sealant is 1.2 to 1.0, and wherein the base agent has an epoxy group and the curing agent is an acid anhydride curing agent, and wherein the content of the acid anhydride curing agent included in the first sealant and the content of the acid anhydride curing agent included in the second sealant are within the range of 90 to 99 percent by mass relative to an epoxy equivalent of the base agent.

9. The method for manufacturing a liquid ejection head, according to claim 8, wherein the first sealant and the second sealant have the same type of filler.

10. The method for manufacturing a liquid ejection head, according to claim 8, wherein the average particle diameter of the filler included in the first sealant is larger than the average particle diameter of the filler included in the second sealant.

11. The method for manufacturing a liquid ejection head, according to claim 8, wherein the filler is silica.

12. The method for manufacturing a liquid ejection head, according to claim 8, wherein the first sealant does not contain a thixotropic agent and the second sealant contains a thixotropic agent.

13. The method for manufacturing a liquid ejection head, according to claim 8, wherein the difference between the content of the filler included in the first sealant relative to the first sealant and the content of the filler included in the second sealant relative to the second sealant is within 3 percent by mass.

14. The method for manufacturing a liquid ejection head, according to claim 8, wherein the content of the filler included in the first sealant relative to the first sealant and the content of the filler included in the second sealant relative to the second sealant are within the range of 50 to 80 percent by mass.

* * * * *